United States Patent [19]

Garcia

[11] Patent Number: 5,017,160

[45] Date of Patent: May 21, 1991

[54] REPLACEABLE SEAL FOR ELECTRICAL CABLES IN A SEVERE ENVIRONMENT

[75] Inventor: Rudy J. Garcia, Round Rock, Tex.

[73] Assignee: W. L. Gore & Associates, Inc., Newark, Del.

[21] Appl. No.: 502,155

[22] Filed: Mar. 28, 1990

[51] Int. Cl.[5] ..... H01R 13/40

[52] U.S. Cl. ..... 439/750; 439/588; 439/271

[58] Field of Search ..... 439/271–283, 439/738, 750, 587, 588, 744, 746; 174/93, 84 R

[56] References Cited

U.S. PATENT DOCUMENTS

| | | | |
|---|---|---|---|
| 2,037,630 | 4/1936 | Hudson | 173/328 |
| 2,782,391 | 2/1957 | Kirk | 339/211 |
| 2,881,406 | 4/1959 | Arson | 439/281 |
| 2,935,720 | 5/1960 | Lorimer | 339/94 |
| 3,085,138 | 4/1963 | Brown et al. | 439/750 |
| 3,165,575 | 1/1965 | Lynch, Jr. et al. | 174/84 |
| 4,090,759 | 5/1978 | Herrmann, Jr. | 339/60 M |
| 4,501,927 | 2/1985 | Sievert | 439/750 |
| 4,614,392 | 9/1986 | Moore | 439/738 |
| 4,664,461 | 5/1987 | Schubert et al. | 439/271 |
| 4,917,632 | 4/1990 | Smith | 439/278 |

FOREIGN PATENT DOCUMENTS

| | | | |
|---|---|---|---|
| 0669986 | 10/1964 | Italy | 439/746 |

*Primary Examiner*—David L. Pirlot
*Attorney, Agent, or Firm*—Gary A. Samuels

[57] ABSTRACT

A replaceable heat, pressure, and corrosive chemical resisting elastomeric boot for sealing the connector joint of an electrical cable passing through a bulkhead of a downhole tool for logging oil or gas wells.

1 Claim, 2 Drawing Sheets

REPLACEABLE SEAL FOR ELECTRICAL CABLES IN A SEVERE ENVIRONMENT

FIELD OF THE INVENTION

The invention relates to elastomeric sealing boots or seals or enclosing electrical connector joints in terminations of electrical cables, particularly with respect to oil or gas well logging equipment.

BACKGROUND OF THE INVENTION

In logging instrumentation or equipment or logging tools used under high pressure and temperature downhole under harsh chemical conditions, electrical cables terminating on the logging tool are usually hermetically sealed by use of elastomeric materials which are molded into or permanently a part of the cable connectors. The seals provide good liquid seals under lower pressures or under less harsh chemical environments. Under repeated use under high pressure and harsh conditions, however, the seals tend to break down under explosive decompression, a form of deterioration of the seal wherein small molecules of gases from the pressurized environment permeate the elastomer of the seal and accumulate in microscopic voids in the elastomer. When the logging tool is removed from a deep well, the pressure on the tool is rapidly released. The accumulated gases cannot escape from the voids quickly enough and expand, thus causing the elastomeric material of the seals to blister and cut. This often will cause the entire electrical cable harness to be scrapped because the sealing material will no longer form a hermetic seal if the elastomeric seal is incorporated into the cable connector as a component of the connector.

SUMMARY OF THE INVENTION

The problem described above can be solved and the loss of the entire cable harness avoided by making the elastomeric boot or seal portion of the connector a separate component from the connector or cable harness. The seal or boot will function downhole under heat and pressure to prevent liquids from entering the cable connection to the logging tool, thereby interfering with or shorting a signal within the cable, but can be easily removed and replaced between logging runs when damaged by gas blistering and/or other damage caused by the downhole heat, pressure, and chemical environment. The seal or boot of the invention fits resiliently over the end of a bulkhead connector over a conventional bead or doughnut shaped retaining ring circumscribing that connector and over a similar bead or doughnut shaped ring provided on the metal portion of the connector mated to the electric cable. The seal or boot of the invention is snapped over the bulkhead bead or ring on the bulkhead connector, and the elastomeric seal snapped over the area of the bead or ring on the cable connector. The logging tool is then lowered into the well to relay signals from downhole to the instrumentation at the surface above the well. Upon completion of the logging run, the tool is withdrawn from the well, the cable disconnected, and the seal or boot discarded if damaged.

DETAILED DESCRIPTION OF THE INVENTION

Figure 1:
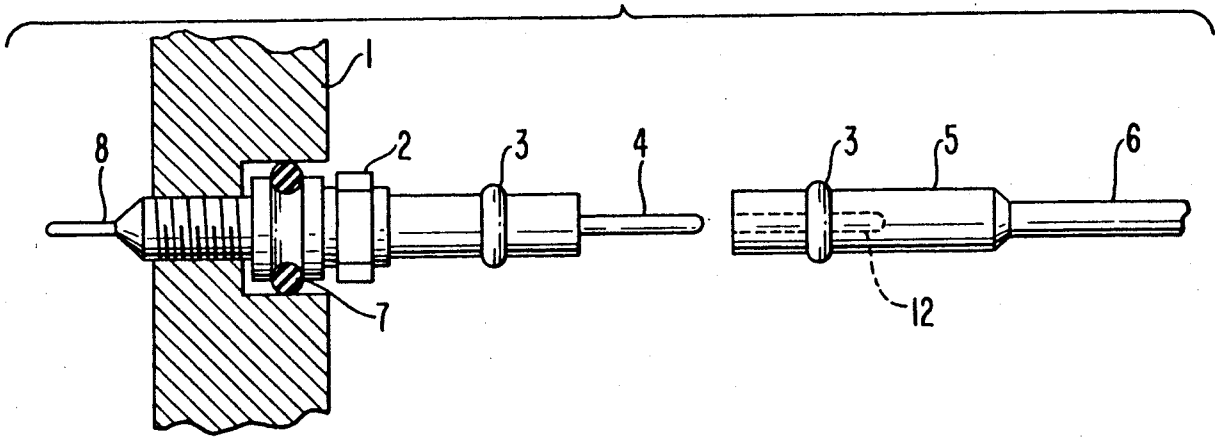
FIG. 1 describes a male bulkhead connector and a cable with female connector in alignment ready to be attached.
Figure 3:
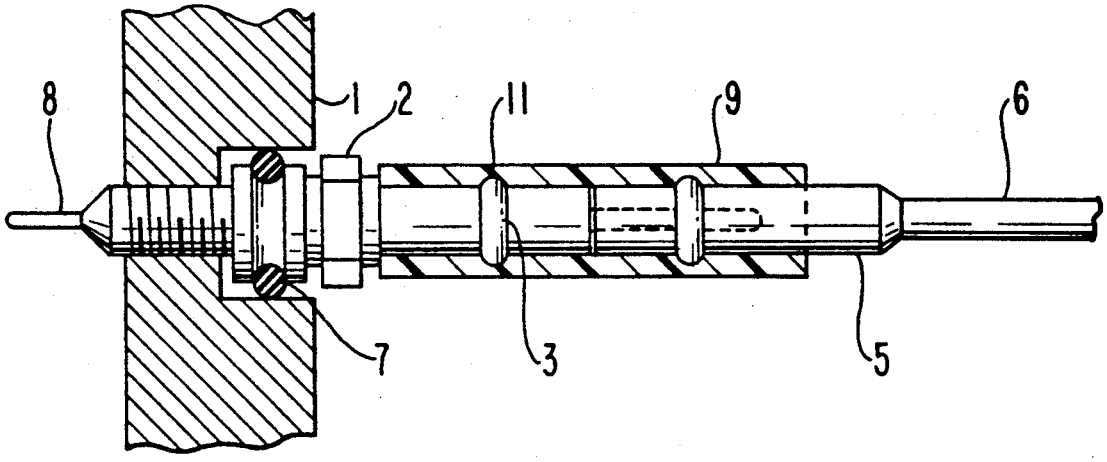
FIG. 3 depicts a seal or boot fitted in place to seal a bulkhead connector with a cable connector.

With reference to the figures, FIGS. 1 and 3 depict a single conductor cable terminated to a female connector which is compatible with a male bulkhead connector. Both connections have a doughnut type bead or ring 3 raised around and circumscribing the surface of the connector. Such bulkhead connectors are commonly used in the art and are not unique to the invention.

Cable 6, shown in FIGS. 1 and 3, is a standard cable, comprising one or more conductors, and a chemical and heat resistant insulation or sheath. The insulating sheath of the conductor may be of PEEK (polyether ether ketone), Teflon PFA (polyfluoroalkoxy tetrafluoroethylene), polytetrafluoroethylene. or comparable fluorocarbon or other thermoplastic polymer material. The cable is terminated in a standard manner by crimping or soldering, for example to a connector socket. The connector and attached cable are then embedded by molding into suitably high-temperature resistant and chemical resistant thermoplastic, such as PEEK or PFA. A separate molded connector housing could also be used and fixed in place over the connector socket, such as by epoxy adhesive, instead of embedding in a molded plastic. These materials could also be high-temperature resistant thermoplastic or thermoset resin. The bond between the sheath of the cable and the molded connector 5 is very important to pressure, heat, and chemical resistance of the cable connector joint and bonding of the sheath and connector materials together is highly desirable. Formed on the molded connector body 5 is a raised doughnut or bead shaped ring 3 circumscribing body 5. Body 5 with raised ring 3 is comparably sized and spaced from the connector end to match the equipment parts of the bulkhead connector. Connector body 5 usually has a female pin contact 12, shown dotted inside body 5.

The bulkhead connector, usually having a male connector pin 4, is mounted on and passes through bulkhead 1. 0-rings 7 are typically used to seal liquids out of the passage through the bulkhead, along with other suitable sealing systems. A raised ring or bead 3, suitably dimensioned and shaped to match the equivalent portions of the cable connector is also present as well as termination pin 8.

Figure 2:
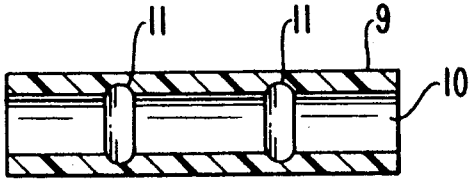
FIG. 2 shows a cross-section of the boot or seal of the invention.

The seal or boot 9 of the invention, shown in FIG. 2, is molded from a high-temperature elastomer, such as Viton fluoroelastomer. Other elastomers of equivalent high-temperature properties, such as fluorosilicone rubber, other fluoroelastomers, or chlorinated rubber, may be used. Boot 9, as shown in FIG. 2, is essentially a cylindrical elastomer tube having an internal diameter to match the outside diameter of cable connector 5 and that of the bulkhead connector. Two grooves 11 are molded into boot 9, usually equidistant from the ends, to snap over and match beads 3. The cable connector 5 is slipped into opening 10 of boot 9 and the assembly then fitted onto the bulkhead connector, including fitting carefully onto bead 3 and pin 12. The joint is now sealed against strong corrosive liquids under high pressure.

Since boot 9 is elastomeric, it will eventually gas-blister and fail under such conditions, but it can be easily and economically replaced at that time without it being necessary to scrap the expensive cable/connector assembly as well.

Where less severe conditions may be encountered, such as in pipelines, a seal or boot 9 could be made of less temperature resistant materials, such as thermoplastic elastomers and elastomers, such as polyurethane or nitrile rubber.

FIG. 3 describes the bulkhead and cable connectors fitted together inside seal 9 with grooves 11 and beads 3 fitting together to effect a sealed joint.

Figure 4A:
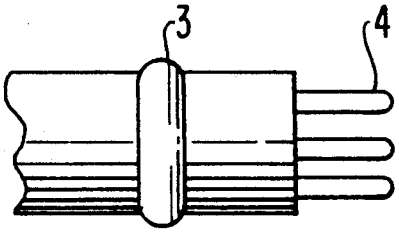
FIGS. 4A and 4B describes a multiple pin connector for use with the boot of the invention.
Figure 4B:
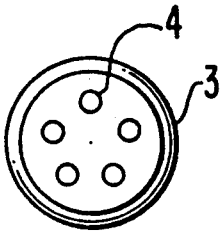

The scope of this invention is not limited to single conductor cables going into single pin connectors. Multiple conductor cables, such as that shown in FIG. 4, including bead 3 and pins 4, consisting of individually insulated primaries, twisted pair constructions, or shielded constructions can also be used with this invention. Multiple pin connectors also fall into the scope of the invention where a smooth cylindrical sealing surface similar to that already described is present.

Other variations to the shapes, spacing, and materials may be made without departing from the scope of the invention which is delineated by the appended claims.

I claim:

1. A connector assembly for use in severe environments comprising in operation relationship:

(a) a bulkhead connector, including a raised ring or bead protuberance circumscribing said connector;

(b) a matching molded electric cable connector, including a raised ring or bead protuberance circumscribing said connector; and (c) fitted over said connectors when joined together, a matching cylindrical high-temperature and corrosion resistant elastomeric sealing boot, said boot having molded internal grooves spaced from each end of said boot to fit closely over said matching raised ring or bead protuberances circumscribing said cable connectors at predetermined locations on said connectors thereby to effect a liquid-tight seal of and a mechanically locked connection of said connectors when joined together, said boot being selected from the group consisting essentially of Viton fluoroelastomer, fluorosilicone rubber, fluoroelastomers, chlorinated rubber, nitrile rubber, and elastomeric polyurethane.

* * * * *